United States Patent [19]

Parish et al.

[11] Patent Number: 4,968,277

[45] Date of Patent: Nov. 6, 1990

[54] AUTOMATIC FLOTATION DEVICE

[75] Inventors: Lane Parish, Beaumont; Ben Windham, Orange, both of Tex.

[73] Assignee: Eagle Electronics, Inc., Beaumont, Tex.

[21] Appl. No.: 345,074

[22] Filed: Apr. 28, 1989

[51] Int. Cl.[5] ..... B63C 9/125

[52] U.S. Cl. ..... 441/93; 441/10

[58] Field of Search ..... 441/10, 80, 88, 90, 441/92, 93, 94, 96, 97, 101; 102/16; 405/185

[56] References Cited

U.S. PATENT DOCUMENTS

| | | | |
|---|---|---|---|
| 3,130,424 | 4/1964 | Santangelo | 441/94 |
| 3,426,942 | 2/1969 | McMains et al. | 441/94 |
| 3,605,418 | 9/1971 | Levine | 405/185 |
| 3,722,408 | 3/1973 | Fox et al. | 102/16 |
| 4,024,440 | 5/1977 | Miller | 441/94 |

FOREIGN PATENT DOCUMENTS

| | | | |
|---|---|---|---|
| 1557300 | 2/1969 | France | 441/96 |

*Primary Examiner*—Joseph F. Peters, Jr.
*Assistant Examiner*—Jesus D. Sotelo
*Attorney, Agent, or Firm*—Pravel, Gambrell, Hewitt, Kimball, & Krieger

[57] ABSTRACT

An automatic flotation device is disclosed which uses an electric circuit to fire a detonator or allow a spring loaded arm to open a $CO_2$ cartridge which then in turn inflates a bladder which lifts a swimmer to the surface. The circuitry utilizes a pressure sensor to determine the depth of the swimmer under the surface. The circuitry is such that if the swimmer has been below a first depth for a given period of time the bladder is inflated or if the swimmer has been below a second, greater depth for any interval the bladder is inflated.

22 Claims, 3 Drawing Sheets

AUTOMATIC FLOTATION DEVICE

BACKGROUND OF THE INVENTION

1. Field of the Invention.

The invention generally relates to automatic flotation devices, and more particularly to devices which inflate after being submerged in water.

2. Description of the Prior Art.

People have an affinity for the seashore or lakefront so that they can enjoy the environment and go swimming for recreational purposes. However, this enjoyment can be dramatically diminished if the people have to spend great amounts of time preventing possible accidents. For example, if an entire family goes to the beach and that family includes small children who are not skilled swimmers, then the parents have to expend a great amount of effort watching the children to make sure they are not harmed or possibly drowned. This concentration diminishes the enjoyment of the trip for the parents and increases their stress levels.

Certain approaches to resolve this safety problem have been developed in the past, but these approaches are generally relatively uncomfortable or impede mobility of the swimmer. Examples include the use of conventional life vests and, in the case of small children, the use of inflatable arm bands. All of these devices generally limit the mobility of the swimmer so that complete freedom cannot be enjoyed. Therefore, the devices are often not worn by older children who have developed some skill at swimming but are not sufficiently proficient at all levels and in many cases may have momentary lapses in capabilities or panic in emergency situations.

Further, even an experienced swimmer may have difficulty in certain water conditions, for example when a very strong undertow exists. Therefore even for extremely experienced swimmers there is a possibility that they could be submerged for too great a period of time and drown. .

There are a number of examples where devices inflate upon sensing the presence of any water. The classic example is an inflatable emergency raft which upon being thrown into the water, immediately or after a short time delay, opens a compressed gas cartridge to cause the raft to automatically inflate. That way the escaping parties need not bother with the problem of trying to find a pin or other inflation trigger. Some of the devices have incorporated a time delay so that they do not open immediately upon entering the water but wait a period of time to make sure that the water truly is present and it is appropriate to inflate. These devices are not appropriate for use with a swimmer because then the swimmer could not even enter the water without the device inflating. This type of device might be appropriate for protecting a child who is not allowed to enter the water, but is not be appropriate for a swimmer who desires to enter the water and perform some activities. Thus, devices which inflate upon mere entry into the water are not appropriate for use with the swimmer.

Further, there are conditions where a swimmer may desire to be underwater a given depth for certain intervals, such as when snorkeling. In those cases a simple water detection or delay system would not respond appropriately.

SUMMARY OF THE INVENTION

The automatic flotation device of the present invention senses the applied water pressure and if the pressure exceeds a first amount, indicating a first depth, for greater than a preset time, a detonator is fired to open a compressed gas cartridge to inflate a vest or bladder. Further, if the sensed water pressure is such that it indicates that the swimmer is below a second, greater depth then the detonator is immediately fired to cause the cartridge to inflate the bladder.

A pressure sensor having an electrical output is connected to a differencing amplifier. The output from the differencing amplifier is increased by a gain amplifier stage. The resulting signal is provided to two different comparators, the first comparator being set to the first depth and the second comparator being set to the second depth. The output of the first comparator is provided to enable operation of an oscillator or timer. The oscillator output is provided to a counter so that if the oscillator produces an output signal for a preset time, a signal is produced by the counter. The output from the counter and the output from the second comparator are combined so that if either one is present a detonator is fired. The detonator is arranged so as to open a $CO_2$ cartridge and allow the expanding gas to be transmitted to a bladder or vest. The bladder can be attached to the swimmer's suit for instance, allowing the entire unit to be built in to the swimsuit and thus not impede the enjoyment of the swimmer and yet allow safety precautions to be taken.

An alternate embodiment does not utilize a detonator. An arm is attached to a pin protruding from the $CO_2$ cartridge. The arm is biased by a spring and retained in position by a cord. The cord is parted by heating it with a resistor when inflation is needed, allowing the spring to move the arm, which in turn bends the $CO_2$ cartridge pin, breaking the seal of the $CO_2$ cartridge and releasing the gas.

BRIEF DESCRIPTION OF THE FIGURES

A better understanding of the invention can be obtained with the following detailed description of the preferred embodiment is considered in conjunction with the following drawings, in which.

DETAILED DESCRIPTION OF THE ALTERNATE EMBODIMENTS

Figure 2:
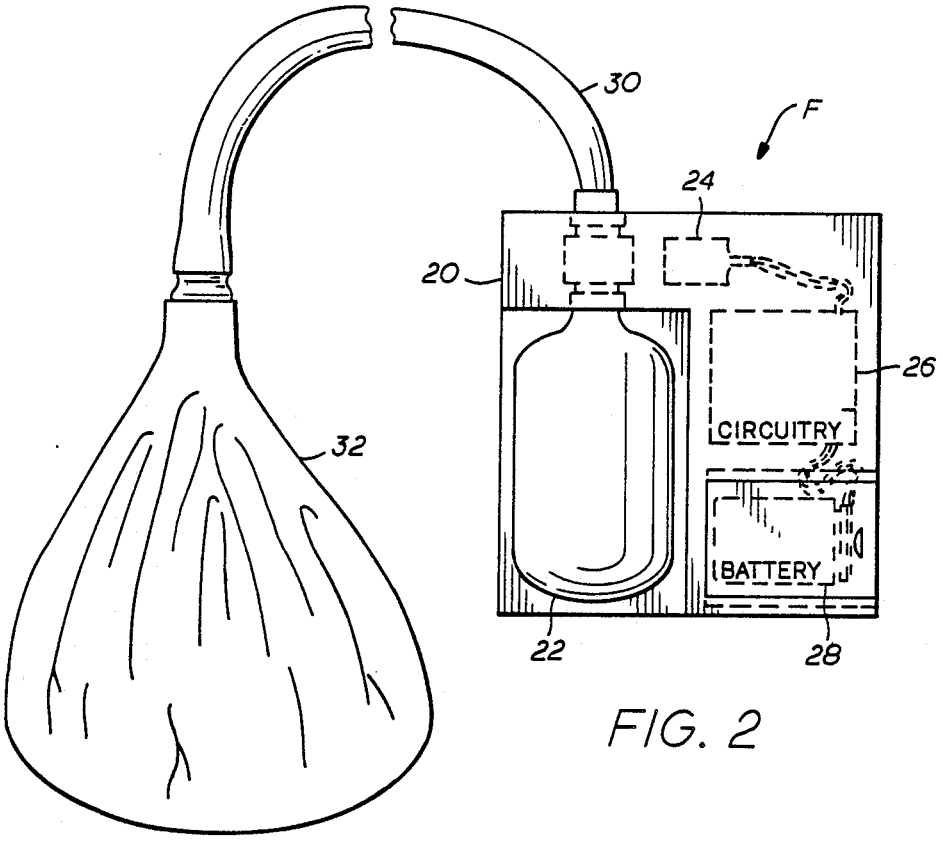
FIG. 2 is a physical representation of an automatic flotation device according to the present invention.
Figure 3:
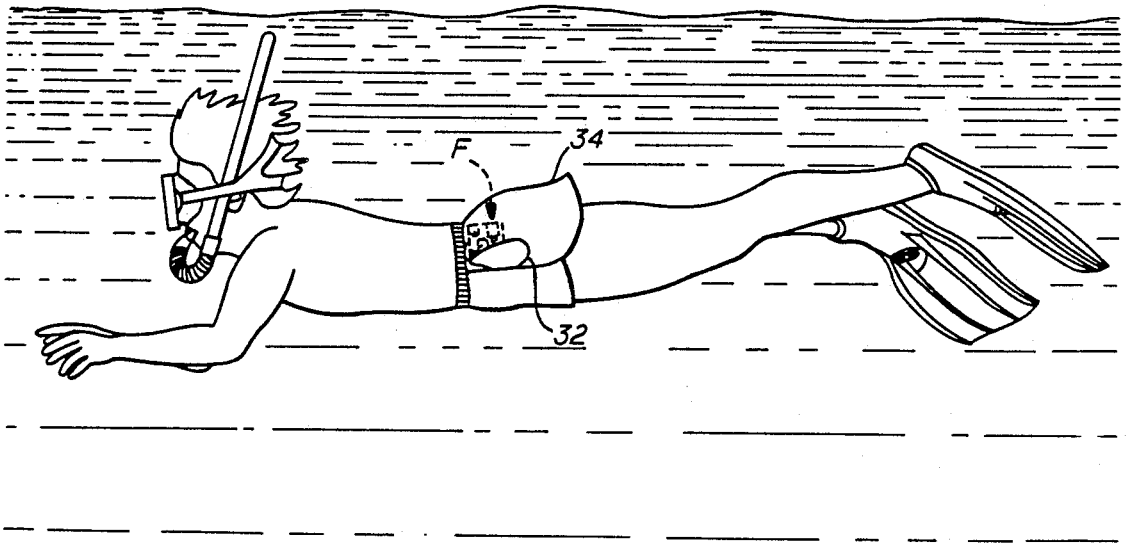
FIG. 3 is a drawing illustrating an automatic flotation device of the present invention located in a swimming suit.

Referring now to FIG. 2, the letter F generally represents an automatic flotation device according to the present invention. The automatic flotation device F has a housing 20 to which the various other components are mounted. A $CO_2$ cartridge 22 is mounted to the housing 20 to provide the compressed gas used to inflate a bladder 32. A detonator 24 is positioned and ported to open the $CO_2$ cartridge 22 when triggered by an electrical pulse. This electrical pulse is provided by circuitry 26, which in turn is powered by a battery 28. When the circuitry 26 determines it is time to inflate the bladder 32, the circuitry 26 fires the detonator 24, which opens the $CO_2$ cartridge 22, allowing the released gas to travel through a connecting tube 30 to the bladder 32.

The bladder or balloon 32 is preferably located in a swimming suit 34 and is formed of a highly expandable material which is sufficiently durable to withstand aging effects, saltwater or fresh water environments and normal handling and cleaning of the swimming suit 34 to which it is attached. Alternately, the bladder 32 can be located in a vest (not shown) or other location. The bladder 32 is connected to the automatic flotation device F by the connecting tube 30, which is of sufficient length to allow the bladder 32 to be positioned as desired. The automatic flotation device F is of a sufficiently small size so as to be conveniently placed in the swimming suit 34 and not interfere with the movements of the swimmer.

Figure 4:
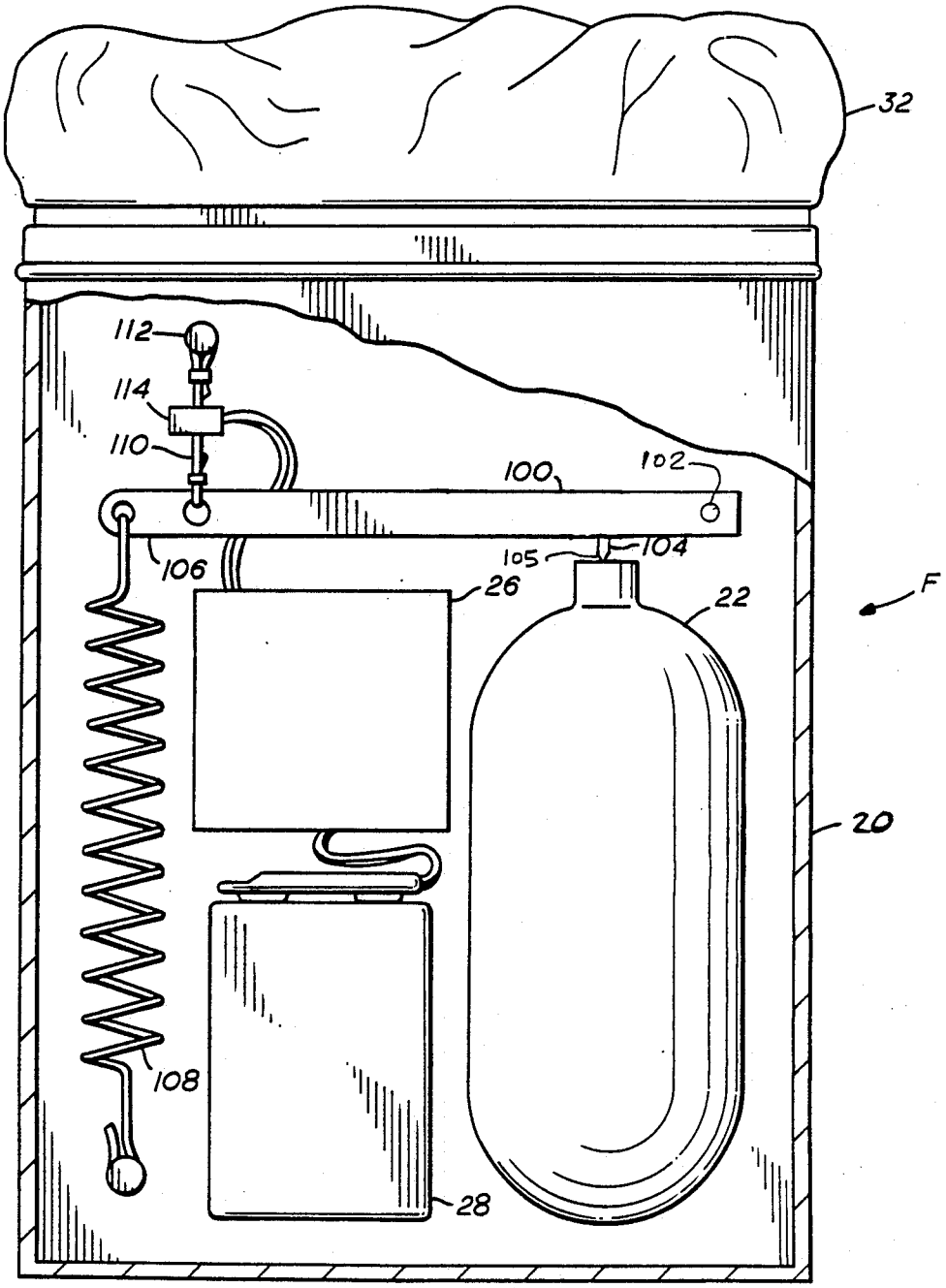
FIG. 4 is an alternate physical representation of an automatic flotation device according to the present invention.

An alternate embodiment of the automatic flotation device F not requiring a detonator 24 is shown in FIG. 4. An arm 100 is located near the top of the housing 20. The arm 100 has located at one end a pivot pin 102 about which the arm 100 rotates. Located on the arm 100 and near the pivot pin 102 is a puncturing pin 104. The puncturing pin 104 has a sharp point 105 in contact with or close proximity to the conventional $CO_2$ cartridge 22, so that when the arm 100 pivots downwardly, the puncturing pin 104 is forced into the $CO_2$ cartridge 22, releasing the compressed gas. The end of the arm 100 away from the pivot pin 102 has an attachment portion 106. To this attachment portion 106 are connected a spring 108, which tends to cause the arm 100 to move laterally and downwardly, and a retaining cord 110. The retaining cord 110 is wrapped around the attachment portion 106 and is fixedly attached to the housing 20 by a pin 112. The length of the retaining cord 110 is such that the retaining cord 110 holds the arm 100 in a position where the $CO_2$ cartridge 22 remains closed. The retaining cord 110 is preferably of such a size and made of such a material to readily burn or melt when heat is applied, for example, 80 pound multi-strand nylon cord.

A resistor 114, preferably an 11 ohm, $\frac{1}{4}$ watt metal film component or other material which produces sufficient heat to part the retaining cord 110 before the resistor 114 stops operating, is connected to the retaining cord 110. When the circuitry 26 determines that it is time to inflate the bladder 32, the resistor 114 is energized and develops heat, the heat developed by the resistor 114 severing the retaining cord 110, allowing the spring 108 to move the arm 100 to open the $CO_2$ cartridge 22.

The bladder 32 in this embodiment is preferably attached directly to the housing 20, thus not requiring the use of a connecting tube 30 and reducing possible problems relating to porting the gas from the $CO_2$ cartridge. A relatively large hole (not shown) is in the top of the housing 20, so that the inside of the housing 20 and the bladder 32 are in communication, the $CO_2$ cartridge 22 thus pressurizing the housing 20 and the bladder 32.

Figure 1:
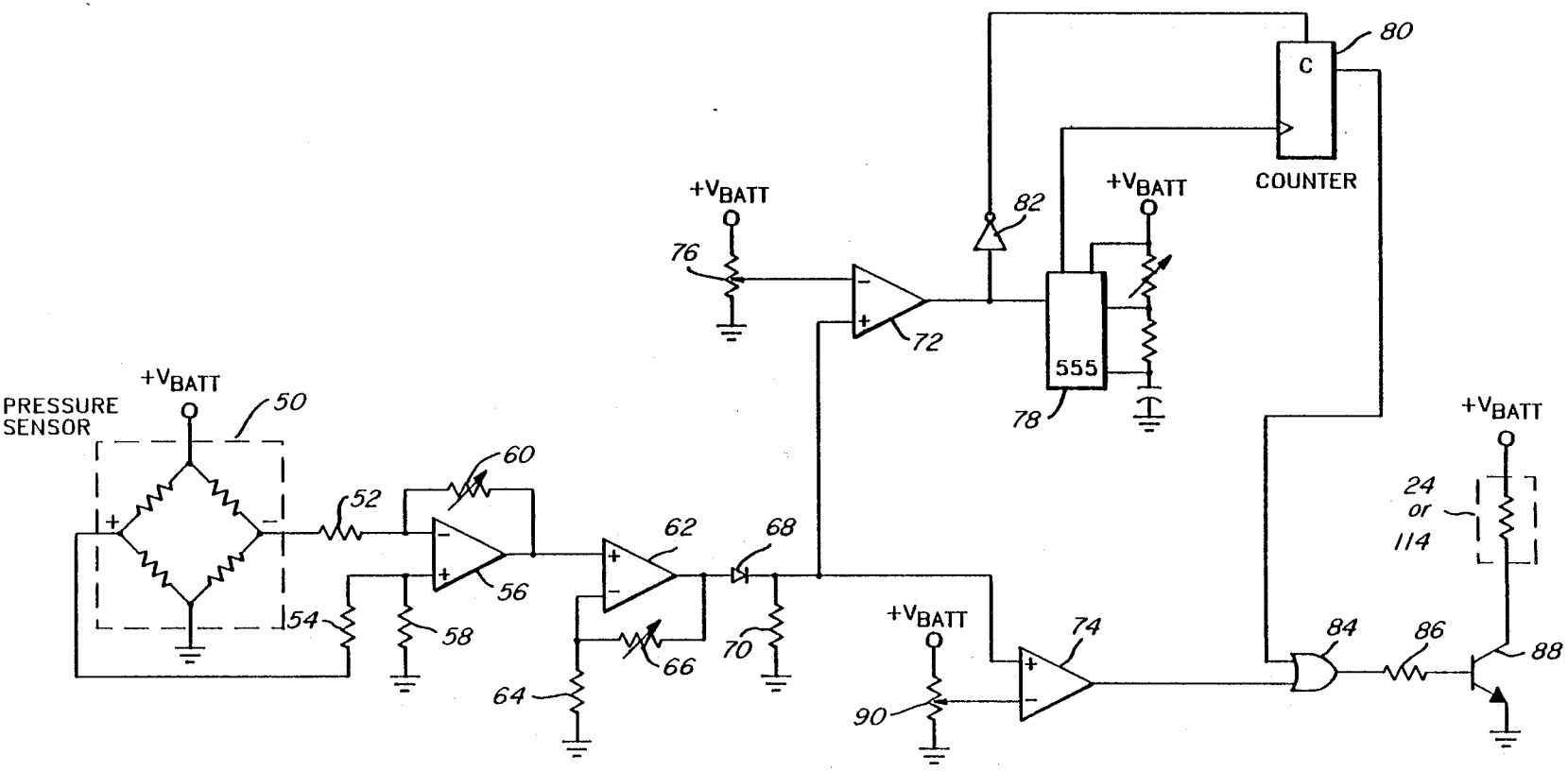
FIG. 1 is an electrical schematic diagram of an automatic flotation device according to the present invention.

The inflation circuitry 26 is shown in more detail in FIG. 1. A pressure sensor 50 is utilized to determine the water pressure. The pressure sensor 50 is preferably configured to simulate a bridge-type electrical circuit so that the resistances of various legs of the bridge change as the pressure applied to the pressure sensor 50 changes. A suitable sensor for use in the automatic flotation device F is the CC15D pressure sensor manufactured by SenSym of Sunnyvale, Calif. This particular sensor has an operating range of zero to 15 psi and can operate in differential or gage mode. Two of the terminals of the pressure sensor 50 are connected to the battery voltage and ground to provide power to the bridge circuit in the pressure sensor 50. The two remaining terminals of the pressure sensor 50 are connected through resistors 52 and 54 to the inverting and non-inverting terminals of an operational amplifier 56. The operational amplifier 56 is configured in a differencing mode to remove any common mode signal present in the pressure sensor 50. A resistor 58 is connected from the non-inverting terminal to ground and a variable resistor 60 is connected from the output of operational amplifier 56 to the inverting terminal. The variable resistor 60 is used in the feedback loop to allow zeroing of the output of the operational amplifier 56 so that a properly zero referenced value can be output when zero water pressure is being applied to the pressure sensor 50.

The output of the operational amplifier 56 is also connected to the non-inverting terminal of an amplifying operational amplifier 62. A resistor 64 is connected between the inverting input of the operational amplifier 62 and ground and a variable resistor 66 is connected between the output of the operational amplifier 62 and the inverting input. This is a simple non-inverting configuration for the amplifier stage and is used to increase the difference signal output by the pressure sensor 50 and the differencing operational amplifier 56 to acceptable limits for use in the remaining portions of the circuitry. The output of the amplifying operational amplifier 62 is connected to the anode of a diode 68. The cathode of the diode 68 is connected to a resistor 70 which is connected to ground and to the non-inverting inputs of two comparators 72 and 74. The diode 68 insures that only positive level voltage signals are applied to the comparators 72 and 74 from the operational amplifier 62.

The first comparator 72 is preferably an operational amplifier operating as a comparator and has a reference voltage connected to the inverting terminal. The reference voltage is produced by a time delay depth potentiometer 76 which has its two terminals connected to ground and to the battery voltage and has the wiper connected to the inverting terminal of the comparator 72. The voltage set on the time delay depth potentiometer 76 is representative of the first or shallower depth under consideration. The comparator 72 is configured so that whenever the pressure exceeds the preset or reference level the output goes high.

The output of the comparator 72 is connected to the reset input of a timer 78. The timer 78 is preferably a 555 timer standardly used in the industry. The timer 78 is configured for astable operation to form an oscillator and has appropriate resistors and capacitors attached to provide a frequency of approximately 5 Hz. If a variable resistor is utilized in the timing components as shown, the frequency can be changed if desired. The output of the timer 78 is provided to the clocking input of a ripple-carry binary counter 80. The counter 80 is used to divide the frequency of the waveform provided by the timer 78 by a given amount so that the timer 78 can operate well within its operating range and not be forced to operate near or outside its specified limits of operation. In the preferred embodiment the counter 80 divides by 128. In a variation, a switch (not shown) can be connected to different divider outputs of the counter 80 to allow the user to select the desired delay time. In this variation, a longer divider output than selectable by the user is always used in conjunction with the user outputs to increase the probability that the bladder 32 will be inflated if the delay time switch malfunctions.

The output signal from the comparator 72 is also provided to an inverter 82 whose output is in turn connected to the clear input of the counter 80. Thus, whenever the swimmer is closer to the surface than the desired trigger level, as indicated by the pressure output by the pressure sensor 50 and the reference voltage on the potentiometer 76, the counter 80 is cleared. When the swimmer goes below the desired depth, the clear is released from the counter 80 and the timer 78 begins counting. Given the preferred frequencies of approximately 5 hertz and division by 128, this means that after the swimmer has been underwater below the desired first depth for a period slightly less than thirty seconds, the output of the counter 80 will go high, indicating that it is time to inflate the bladder 32 and bring the swimmer back to the surface. Should the swimmer return closer to the surface than the desired first depth, the counter 80 will be cleared and the timer 78 stopped, allowing the cycle to be restarted the next time the swimmer exceeds the desired first depth.

The output of the counter 80 is provided to one input of an OR gate 84, whose output is in turn provided to the first terminal of a resistor 86. The other terminal of the resistor 86 is connected to the base of an output transistor 88. The emitter of the transistor 88 is connected to ground, while the collector of the transistor 88 is connected to one terminal of the detonator 24, which is perceived electrically as a resistor. The other terminal of the detonator 24 is connected to the battery voltage. Therefore, whenever a one or high level signal is received at either input of the OR gate 84 the transistor 88 is turned on and the detonator 24 is fired to allow the bladder 32 to inflate. Alternately in the embodiment of FIG. 4, the collector of the output transistor 88 is connected to one terminal of the resistor 114, the other terminal being connected to the battery voltage. Thus, when the transistor 88 is turned on, the resistor 114 heats up and burns through the retaining cord 110, allowing the bladder 32 to inflate. In the embodiment of FIG. 4, it is preferable that a latch or one shot (not shown) be inserted between the OR gate 84 and the resistor 86 to allow the resistor 114 to be energized for a greater period of time to allow the retaining cord 110 to be melted. This latch or one shot is not necessary when the detonator 24 is used because only a short pulse is needed to fire the detonator 24.

The second comparator 74 is the immediate fire comparator. This comparator 74 is also preferably an operational amplifier operating as a comparator and has its inverting input connected to the wiper of an immediate fire depth potentiometer 90. The potentiometer 90 has its two terminals connected to ground and the battery voltage so that the wiper can easily provide any voltage between those limits. The reference voltage applied to the inverting input of the second comparator 74 by the potentiometer 90 is adjusted to represent at depth greater than that referenced by the first comparator 72 and is the depth at which it is determined that the swimmer should immediately be brought back to the surface should the swimmer exceed that depth. The output of the comparator 74 is connected to the second input of the OR gate 84, so that whenever the depth exceeds that set by the reference level of potentiometer 90 the detonator 24 is fired or the resistor 114 heated and the bladder 32 inflated.

Therefore in operation the timer delay comparator 72 has a reference level set at a first voltage corresponding to a relatively shallow depth at which the swimmer can swim for a period of time until it is determined that this is a hazardous condition, at which time the bladder 32 inflates and the swimmer is brought to the surface. The immediate fire comparator 74 has its reference level set to correspond to a second, greater depth so that should the swimmer ever exceed this depth the detonator 24 is automatically fired or the retaining cord 110 severed and the swimmer is brought back to the surface. The two depths can be factory set at desired levels by using fixed resistors instead of the potentiometers 76 and 90 or by making the potentiometers 76 and 90 inaccessible. Alternatively, the desired depths can be adjustable by the swimmer based on the individual characteristics of a particular swimmer who will be wearing the unit. Correspondingly, the period of the timer 78 can be set at the factory or changed by the swimmer if a different delay time is desired.

The foregoing disclosure and description of the invention are illustrative and explanatory thereof, and various changes in the size, shape, materials, components, circuit elements, wiring connections and contacts, as well as in the details of the illustrated circuitry and construction may be made without departing from the spirit of the invention.

We claim:

1. A flotation apparatus for a swimmer, comprising:

a bladder for inflating to cause the swimmer to float to the surface;

means for determining the depth of the swimmer underwater;

means responsive to said depth determining means for determining when the swimmer has exceeded a first given depth;

means responsive to said first depth exceeded determinating means for determining the time interval the swimmer has exceeded said first depth; and means responsive to said time interval means for inflating said bladder.

2. The flotation apparatus of claim 1, wherein said inflation means includes a compressed gas cartridge.

3. The flotation apparatus of claim 2, wherein said inflation means further includes an explosive detonation device provided and located to open said compressed gas cartridge.

4. The flotation apparatus of claim 2, wherein said inflation means further includes:

a movable arm having an armed position and a released position and connectable to said compressed gas cartridge so that if said arm moves from said armed position said gas cartridge is opened;

a bias means for causing said arm to move;

a retaining means for retaining said arm in said armed position; and means for releasing said retaining means.

5. The flotation apparatus of claim 4, wherein said retaining means includes a cord and said releasing means includes a heat producing resistor.

6. The flotation apparatus of claim 1, wherein said depth determining means includes a pressure sensor.

7. The flotation apparatus of claim 6, wherein said depth determining means further includes a differencing amplifier connected to said pressure sensor and a gain amplifier connected to said differencing amplifier to provide an electrical signal indicative of the swimmer's depth.

8. The flotation apparatus of claim 1, wherein said first depth exceeded determining means includes a comparator.

9. The flotation apparatus of claim 8, wherein said time interval determining means includes a timer responsive to said comparator and a counter responsive to said comparator and to said timer.

10. The flotation apparatus of claim 1, further comprising:

means for determining when the swimmer has exceeded a second given depth, said second depth being greater than said first depth; and wherein said bladder inflation means is additionally responsive to said second depth exceeded determining means.

11. The flotation apparatus of claim 10, wherein said inflation means includes a compressed gas cartridge.

12. The flotation apparatus of claim 11, wherein said inflation means further includes an explosive detonation device provided and located to open said compressed gas cartridge.

13. The flotation apparatus of claim 11, wherein said inflation means further includes:

a movable arm having an armed position and a released position and connectable to said compressed gas cartridge so that if said arm moves from said armed position said gas cartridge is opened;

a bias means for causing said arm to move;

a retaining means for retaining said arm in said armed position; and means for releasing said retaining means.

14. The flotation apparatus of claim 13, wherein said retaining means includes a cord and said releasing means includes a heat producing resistor.

15. The flotation apparatus of claim 10, wherein said depth determining means includes a pressure sensor.

16. The flotation apparatus of claim 15, wherein said depth determining means further includes a differencing amplifier connected to said pressure sensor and a gain amplifier connected to said differencing amplifier to provide an electrical signal indicative of the swimmer's depth.

17. The flotation apparatus of claim 10, wherein said first depth exceeded determining means includes a comparator.

18. The floatation apparatus of claim 17, wherein said time interval determining means includes a timer responsive to said comparator and a counter responsive to said comparator and to said timer.

19. The flotation apparatus of claim 18, wherein said second depth exceed determining means includes a second comparator.

20. The flotation apparatus of claim 19, wherein said inflation means includes an OR gate connected to said timer and said second comparator.

21. A flotation apparatus for a swimmer, comprising:

a bladder for inflating to cause the swimmer to float to the surface;

means for determining the depth underwater of the swimmer;

means responsive to said depth determining means for determining when the swimmer has exceeded a given depth; and means responsive to said depth exceeded determining means for inflating said bladder;

wherein said inflation means includes a compressed gas cartridge; and wherein said inflation means further includes an explosive detonation device provided and located to open said compressed gas cartridge.

22. A flotation apparatus for a swimmer, comprising:

a bladder for inflating to cause the swimmer to float to the surface;

means for determining the depth underwater of the swimmer;

means responsive to said depth determining means for determining when the swimmer has exceeded a given depth; and means responsive to said depth exceeded determining means for inflating said bladder;

wherein said depth determining means includes a pressure sensor; and wherein said depth determining means further includes a differencing amplifier connected to said pressure sensor and a gain amplifier connected to said differencing amplifier to provide an electrical signal indicative of the swimmer's depth.

* * * * *